US007416082B2

(12) United States Patent
Roesler

(10) Patent No.: US 7,416,082 B2
(45) Date of Patent: Aug. 26, 2008

(54) HANGER FOR DRILLS

(76) Inventor: Peter Roesler, Ifenweg 3, D-88239 Wangen/Allgau (DE)

( * ) Notice: Subject to any disclaimer, the term of this patent is extended or adjusted under 35 U.S.C. 154(b) by 10 days.

(21) Appl. No.: 11/095,691

(22) Filed: Mar. 31, 2005

(65) Prior Publication Data

US 2005/0252870 A1 Nov. 17, 2005

(30) Foreign Application Priority Data

Apr. 1, 2004 (DE) ..... 20 2004 005 388 U
Jan. 25, 2005 (DE) ..... 10 2005 003 416

(51) Int. Cl.
*B65D 85/28* (2006.01)

(52) U.S. Cl. ..... 206/379; 206/806

(58) Field of Classification Search ..... 206/349, 206/379, 380, 478, 480, 486, 488, 490, 495, 206/806, 820; 211/70.6
See application file for complete search history.

(56) References Cited

U.S. PATENT DOCUMENTS

| | | | | |
|---|---|---|---|---|
| 878,233 | A * | 2/1908 | Paulson | 211/74 |
| 3,978,984 | A * | 9/1976 | Cowley | 206/379 |
| 5,484,056 | A | 1/1996 | Wood | |
| 6,116,449 | A * | 9/2000 | Chiesi et al. | 220/23.4 |
| 6,241,092 | B1 * | 6/2001 | Vasudeva | 206/349 |
| 6,425,482 | B1 | 7/2002 | Chiang | |
| 6,561,353 | B2 * | 5/2003 | Levieux et al. | 206/490 |
| 6,637,591 | B2 * | 10/2003 | Chen | 206/349 |
| 6,662,948 | B1 | 12/2003 | Velliquette | |
| 2003/0029756 | A1 * | 2/2003 | Vasudeva et al. | 206/379 |

FOREIGN PATENT DOCUMENTS

| | | | |
|---|---|---|---|
| DE | 23 52 752 | B2 | 5/1974 |
| DE | 92 17 513.9 | U1 | 2/1993 |
| DE | 94 02 557.6 | U1 | 7/1994 |
| DE | 94 10 138.8 | U1 | 10/1994 |
| DE | 94 10 538 | U1 | 10/1995 |
| DE | 195 17 519 | A1 | 11/1996 |
| DE | 195 35 971 | A1 | 4/1997 |
| DE | 196 33 261 | A1 | 2/1998 |
| DE | 297 21 437 | U1 | 2/1999 |
| DE | 299 04 169 | U1 | 7/1999 |
| DE | 299 20 551 | U1 | 3/2000 |
| DE | 695 12 878 | T2 | 3/2000 |
| DE | 200 08 259 | U1 | 8/2000 |
| DE | 200 20 389 | U1 | 3/2001 |
| EP | 0 521 410 | A1 | 6/1992 |
| EP | 1 103 482 | A2 | 11/2000 |
| GB | 2 136 276 | A | 3/1984 |

* cited by examiner

*Primary Examiner*—Luan K Bui
(74) *Attorney, Agent, or Firm*—Frederick L. Tolhurst, Esq.; Cohen & Grigsby, P.C.

(57) ABSTRACT

A hanger for drills comprises a plastic part with a tag face, wherein a hole for the penetration of a hanger hook is disposed in the upper area of the tag face, and wherein one or several holding devices enveloping the drill to be held at least partially are disposed at a distance from one another on the tag face. For the purpose of securely holding drills of various shapes, it is provided that at least one holding part is elastically deformed to envelop the drill to be held.

17 Claims, 3 Drawing Sheets

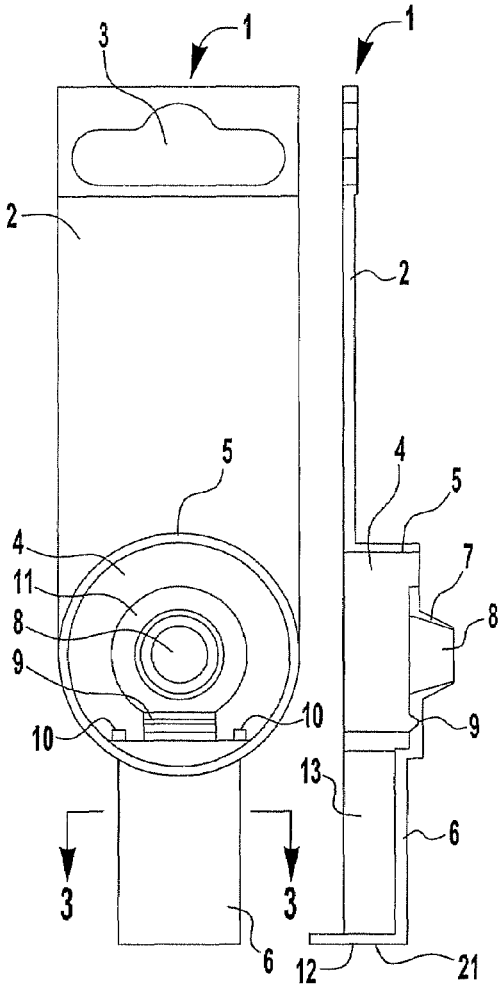
FIG. 1
FIG. 2
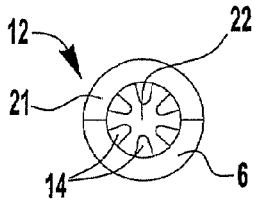
FIG. 3
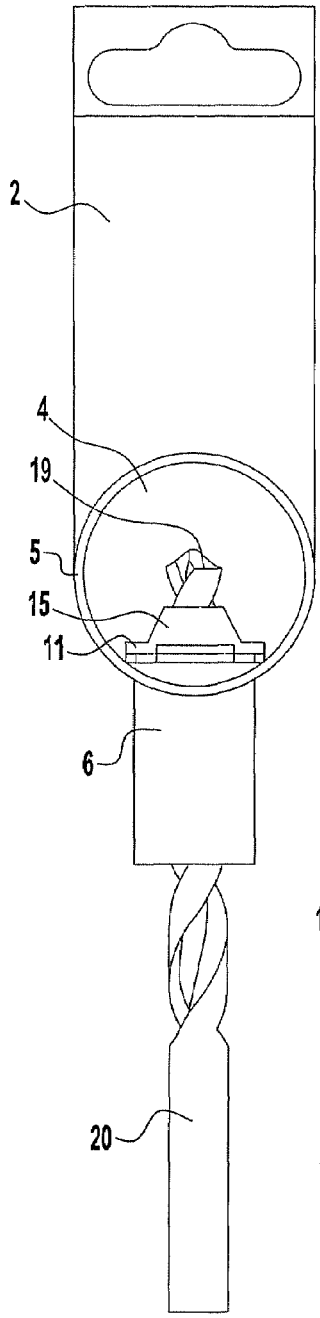
FIG. 4
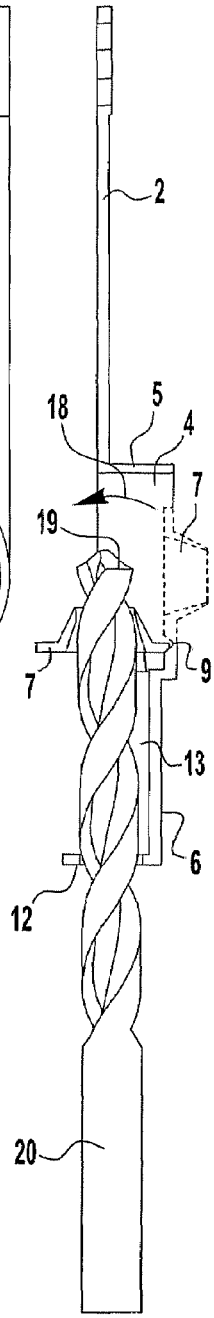
FIG. 5

HANGER FOR DRILLS

The invention relates to a hanger for drills and other comparable objects (e.g. drill-like deburing tools, counterboring tools, and similar) of any type in accordance with the preamble of patent claim 1. A hanger of this type is used as display packaging for drills. Whenever display packaging for drills is mentioned hereinafter, this is not to be understood as limitation. The invention therefore also relates to all drill-like objects braced in this type of hangers constructed as display packaging in a way to prevent the said object from shifting.

Hangers for drills have become known to the art in the form of a tag face constructed on a plastic part with a hole as so-called "Euro-hole" for the suspension disposed in the area of the said tag face (see patent applications EP 1 103 482 A2; U.S. Pat. No. 6,662,948 B1).

The actual hanger part serving to hold the oblong drill is disposed adjoining to the said tag face.

From the patent application U.S. Pat. No. 6,425,482 B1, the possibility is known to the art of disposing on the tag face two spatially separate cable binders enveloping the object to be held in two locations at a distance from one another, thereby pressing the said object firmly against the tag face.

A drill of this type then can, for example, be held on the tag face with the drill point turned upward.

A disadvantage of this arrangement lies in the fact that very costly fabrication is involved, because each drill has to be connected to the tag face by means of two separate cable binders and each cable binder has to be secured.

A further disadvantage lies in the fact that the cable binders have to be tailored precisely to the shape of the drill to be held and have to be seated very tightly in order not to brace the drill too loosely.

The holding force therefore is difficult to adjust; and in the event of a material change in the cable binders, it becomes possible for the drill to drop from the holding surface.

The patent applications EP 1103 482 A2; DE 94 10 538 U1, or DE 299 04 169 U1 have made an additional holding mechanism known which is particularly suitable for SDS drills and other SDS tools. The said holding mechanism is remarkable due to the fact that a holding mechanism especially tailored to the SDS shank of the drill is provided on the tag face. The said holding mechanism comprises two spatially separate holding parts and a web part disposed centrally between the holding parts, said web part protruding and pressing itself into the indentation in the SDS shank, thereby forming a holding mechanism.

A disadvantage of the said SDS holding mechanism, however, lies in the fact that the drill is held in the hanger with the point turned downward, because only a shank-side holding mechanism is provided so that, in the event that the said hanger drops, the drill point always runs the risk of being damaged. A further disadvantage lies in the fact that with the said hanger, the drill point is not displayed in an optically very effective way from the point of view of advertisement, because it is hanging downward.

From the patent application DE 23 52 752, a hanger has become known to the art wherein the object to be held is placed into holding straps open to the front, the said holding straps being elastically deformed to settle at least partially against the outer circumference of the object in a frictional fit. Here, however, the object runs the risk of dropping forward out of the straps.

It was found that in a drill, the expensively constructed drill points, in particular, are the valuable parts arousing the purchasing impulse, which drill points, on the one hand, are not being protected from being damaged, and on the other hand, not optically noticeable due to the conventional packaging.

It is therefore the object of the invention to refine a hanger for drills of the type described above in such a way that the drills are held securely in relative independence from the shape thereof and that one part of the said drill, in particular the point, is optically emphasized as well as protected from being damaged.

In order to achieve the object, the invention is characterized by the enabling disclosure of claim 1.

An essential feature of the invention is the fact that on the tag face, two spatially separate holding parts are disposed, whereof at least the one holding part is constructed as sleeve-like part and is elastically deformed to envelop the point of the drill to be held, and that the said holding part is disposed close to the tag face (disposed above).

From the given enabling disclosure, the advantage can be deduced that, instead of holding the shank, as is the case with SDS drills, a point-side holding mechanism is now provided for the drill.

The point-side holding mechanism is, for example, known to the art from the patent applications DE 200 20 389 U1; U.S. Pat. No. 6,425,482 B1, and U.S. Pat. No. 5,484,056. In the two first-named publications, a screwdriver is fastened to a card-shaped hanger by means of cable binders with the tip turned upward. In addition, the tip is inserted through the central bores of two elastic disks disposed at a distance from one another. The diameter of the respective central bore is smaller than the diameter of the screwdriver tip to be inserted therethrough which therefore is held in a frictional fit.

However, a display of this kind is very costly, because an additional holding mechanism for the elastic disks becomes necessary, and furthermore, the said display is not sufficiently secure, because the holding force is generated by the cable binders and in addition, by the elastic disks. Besides, the disks are required for spacing the screwdriver tip from the surface of the hanger card and for centering the same thereon.

Instead of using elastic disks which are costly to attach, the possibility is known from the patent application DE 200 08 259 U1 that an elastically expanding through-aperture for the tip of the screwdriver to be held can be created by disposing several block pieces on the surface in such a way that the said block pieces are offset in relation to one another in the direction of hanging, the said block pieces forming an elastically expandable through-aperture between their front edges. A holding mechanism of this type, however, is not secure and cannot hold the object to be held precisely in hanging direction.

According to the invention, it is proposed on the other hand to have at least the (upper) holding part—disposed close to the tag face—elastically deformed to enclose the circumference of the drill to be held in a frictional fit, thereby ensuring a reliable holding mechanism relatively independently from the diameter of the drill to be held. The holding part is, in addition, an integral part of the card-shaped hanger card without the need for extra means of attachment.

One refinement provides for stop ribs to be disposed in the holding part constructed in sleeve-like form, with the upward-turned ends of the said stop ribs, as stops, settling against the underside of the drill point which has a larger diameter than the drill. In this manner, the drill point is protected from dropping out of the upper holding part, because the stop ribs disposed in the holding part support the drill point (with enlarged diameter) from below. Drill points of this type are found, in particular, on stone drills.

With this refinement, therefore, very large and heavy stone drills can also be held securely.

However, the invention is not limited to the said refinement. The stop ribs in the interior of the upper holding part may also be omitted. In this case, the drill to be held is held only by frictional fit in the elastomericly deformable holding part (e.g. constructed in cone shape).

An additional embodiment of the invention provides for an additional (lower) holding part to be disposed spatially separately from the elastomericly deformable (upper) holding part, to be located at a distance from the upper holding part, and with the aid of holding webs, to settle against the outer circumference of the drill to be held, thus achieving an additional centering function.

The actual holding force is however generated by the first-named, elastomericly deformable holding part.

Since the fact that the said holding part is disposed close to the tag face (disposed above) is an important feature of the invention, the advantage arises that the drill is now driven through the elastomericly deformable holding part with the point turned upward and that the point can be optically displayed in a special way.

For this purpose, an additional feature of the invention provides for the area of the upper, elastomericly deformable holding part to contain a protective aperture worked into the material of the tag face. The said protective aperture forms an optically noticeable indentation in the tag face. The drill point protrudes precisely into the said indentation.

The said optically noticeable design has the advantage that the product name or the manufacturer's name of the drill manufacturer applied on the tag face is brought optically into close association with the valuable drill point. In the (preferably, though not necessarily) encircling protective aperture in the tag face, the drill point becomes visible from front and back, so-to-speak in "optically enhanced" form, which leads to a particularly optically favorable display.

At the same time, this design has the advantage that any damage to the valuable drill point is avoided in the event that the hanger drops, because the said drill point is fastened to the holding surface in upward turned position. At worst, the drill would then hit the ground with the shank.

In another embodiment, the protective aperture can, however, be fastened on the tag face at a later time in the form of an encircling ring part.

However, the invention is not limited to a holding mechanism for the drill wherein the drill point is turned upward. In an analog application, all aforementioned measures can also be implemented in such a way that the drill is held with the point turned downward. In that case, the functions of the upper holding part and the lower holding part are switched and reversed.

The drill is positioned into a cone-shaped holder by means of force-closed and elastomeric form-fit. The holder may be constructed as sleeve-shaped plastic molded part manufactured of a single-component synthetic material. The said holder may also be constructed as single piece from two components manufactured of two synthetic materials of differing hardness. In both cases, the nearly cylindrical body to be held is firmly held not only by the elasticity, but also by the shape of the cone of the holding part. The cone encloses the helices of the drill, preferably over the entire outer circumference, whereby an optimal frictional fit is obtained.

The lower area of the cone is always larger than the nominal diameter of the drill to be held.

The wall thickness of the cone decreases after the stick-through side of the drill to be held. Due to this fact, the material of the cone settles snugly against the drill to be held and, thanks to its elasticity, increases the friction surface on the spirally outer diameter of the drill to be held.

During the manufacture of the holder, the cone is located parallel to the direction of the forming process. In the fabrication position, the said cone is folded over a film hinge by 90 degrees and held firmly by means of a device with tailored geometry in such a way that, for example, a drill can be pushed into the cone with the aid of the said device against the elastic restoring force and partially also the plastic deformation of the holder. Through an aperture equipped with a plurality of flexible tongues, the drill is centered vertically to its axis in a second holding device.

The upper holding part with the cone may also be disposed multiple times on the axis of the drill to be hung, thereby increasing the holding force.

Furthermore, the swivel motion of the cone is intercepted downward by two webs of suitable construction, because the said webs rest on the plane of the hanger. This causes the film hinge to be relieved of the weight of the drill. The drill is always located precisely under the point of suspension and thus always hangs straight on the holder. The insertion of the objects to be held in the holder may also be automated.

It is also possible to dispose several hangers side by side and connect them to one another. In case of need, individual hangers are removed by means of a sharp object, such as for example scissors.

The invention is not limited to the arrangement of an upper and a lower holding part, wherein the upper holding part is constructed as elastomericly deformable sleeve-like part, while the lower holding part is constructed as centering part.

A refinement of the invention may provide for two elastomericly deformable holding parts to be disposed on the tag face, being aligned with one another and disposed at a distance from one another.

The said embodiment is particularly suited for heavy drills, wherein the holding frictional fit is generated not only by one single holding part, but by several holding parts. Naturally, instead of two elastomericly deformable holding parts, a plurality of elastomericly deformable holding parts may also be provided.

Incidentally, the invention is not limited to holding one cylindrical drill. The cone aperture of the elastomericly deformable holding part has simply to be tailored to the circumference of the object to be held. This means that in the event of rectangular or polygonal parts to be held, the elastomericly deformable cone aperture is tailored correspondingly to the shape of the part to be held.

A further feature of the invention lies in the fact that it is not necessarily required to screw the drill through the elastomericly deformable cone aperture of the holding part in the sense of a screwing motion, in order to position said drill in the hanger.

With the conventional mounting machines, it is sufficient to push the drill through the cone aperture in the sense of a pushing motion, without the need of a screwing motion.

The object according to the invention becomes evident not only from the object of the individual patent claims, but also from the combination of the individual patent claims with one another.

All data and features disclosed in the documentation, including in the abstract, in particular the space-related construction represented in the drawings are claimed as essential for the invention insofar as the said data and features are individually or in combination new in relation to the prior art.

The invention is explained in detail herebelow with reference to drawings representing only a number of ways of execution. In this context, additional essential features and advantages of the invention become evident from the drawings and their descriptions.

FIG. 1 is a front view of the hanger

FIG. 2 is a sectional view along the centerline through FIG. 1

FIG. 3 is a top view of the lower holding part

FIG. 4 is a front view of the hanger with inserted drill

FIG. 5 is a sectional view of FIG. 4

FIGS. 1, 2, 4, 5 show a hanger 1 manufactured of synthetic material and having an upper, relatively flat tag face 2.

Figure 6:
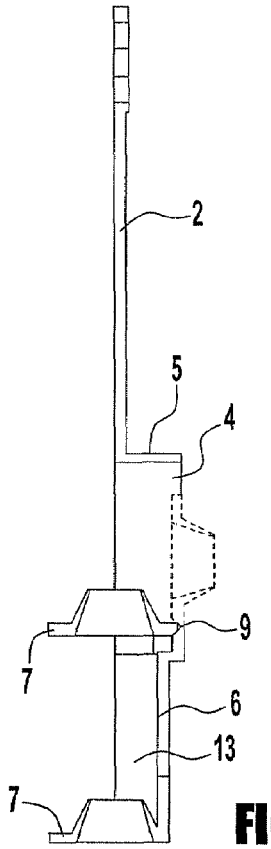
FIG. 6 is a representation according to FIG. 5, though without drill

Incidentally, the invention is not limited to a rectangular tag face. Any tag face of any shape, and incidentally, even three-dimensional tag faces may be used.

Two spatially separate holding parts 7, 12 are disposed on the underside of the tag face, a protective aperture 4 additionally being provided in the tag face 2 for the purpose of the optical presentation of the drill point 19. However, the invention is not limited to this feature.

In an additional embodiment —not shown here—, the protective aperture 4 may be omitted completely, and only the two holding parts 7, 12—still to be described later—are then disposed on an oblong hanger with a tag face 2.

The protective aperture 4 represented here does not only serve the improved optical presentation of the drill point 19, but in addition, imparts a protective effect if the hanger 1 drops to the ground.

In the sense of the description hereabove, the protective aperture 4 is formed into the plane of the tag face 2, said aperture 4 forming an encircling ring wall 5 extending axially forward.

In the lower area of the ring wall 5, the upper, elastomericly deformable holding part 7 is preferably fastened to the holding surface in a way that it can be pivoted over a film hinge 9.

For the manufacture of the entire hanger 1 in an injection mold, the upper holding part 7—shown in an interrupted line in FIG. 5—is at first formed near the film hinge 9 and then, for mounting the drill 20, the said upper holding part 7 is pivoted backward over the pivotable film hinge 9 in direction of the arrow 18 and into the mounting position.

The holding part 7 can be pivoted into the protective aperture 4. A hole 3, also known as Euro-hole, is disposed in the upper part of the tag face 2 in a manner known per se to the art.

The lower part of the tag face extends downward as an approximately semicircular sleeve-like part 6 forming the second holding part 12 at its lower, free end.

It is self-understood that the sleeve-like part 6 may be constructed in any shape. Herein, it is shown in semicircular shape enveloping the drill at approximately 180 degrees of the circumferential surface thereof, in order to offer additional protection.

Naturally, it is possible to construct the sleeve-like part 6 in a perforated form, in order to facilitate a view on the drill therethrough.

Equally, it is possible to construct the sleeve-like part 6 not in the semicircular, but in any other shape.

It is now important to have at least the upper holding part 7 constructed to be elastomericly deformable as sleeve-like part. For this purpose, an encircling ring surface 11 is disposed adjoining to the film hinge 9, said ring surface 11 being connected to the said film hinge 9 by integrated construction using the same material.

Into the interior area of the ring surface 11, the cone aperture 8 is constructed, said cone aperture 8 being defined by the indentation of a ring collar 15 expanding conically outward while extending into the ring surface 11, wherefrom it is formed.

In the event that now the point of a drill to be held, in particular, the drill 20 according to FIGS. 4 and 5, is inserted into the conically tapered ring collar 15, said ring collar 15 will expand radially outward, will be elastomericly deformed, and the entire wall thereof will settle against the spirally outer circumference of the drill to be held in a frictional fit.

The elasticity of the material is adjusted in a way to permanently maintain it and to ensure that the said material will always settle against the outer circumference of the drill 20 in a frictional fit.

For this purpose, it is not necessary to screw the helical drill point of the drill through the cone aperture 8. It is quite sufficient to push the drill 20 longitudinally through the cone aperture 8, whereby the desired holding function is obtained.

As clearly shown in FIGS. 4 and 5, the drill point 19 now protrudes into the protective aperture 4 and there is optimally protected from being damaged, because the ring wall 5 of the protective aperture 4 is extended forward.

This facilitates an excellent, optical presentation, because the drill point, being of great importance to the purchaser, is now read in immediate association with the information printed on the tag face 2.

In order to not subject the film hinge 9 to too much stress due to an excessively strong hanging force, the lower interior area of the protective aperture 4 is to be provided with two spatially separate stops 10 whereon the freely pivoting part of the holding part 7 rests and is supported.

As already mentioned earlier, the lower holding part 12 is disposed in the lower area of the sleeve-like part 6. According to FIG. 3, the said holding part 12 comprises an encircling ring surface 21, wherefrom holding webs 14, radially pointed inward, extend into the interior. The drill 20 is inserted through the receiving aperture 22, with the holding webs 14 being deformed in such a way that they engage in the flutes of the drill 20, thereby centering the drill.

This also generates a certain holding force to be added to the holding force of the upper holding part 7.

It is however important that the centering effect in the lower holding part 12 prevents the drill from oscillating back and forth in the upper holding part 7.

The sleeve-like part 6—as described—is constructed in semicircular shape and therefore forms a protective space 13 enveloping at least partially the outer circumference of the drill 20, thus protecting the same additionally from being damaged.

FIG. 6 shows in an additional embodiment that in the case of particularly heavy objects to be held, two elastomericly deformable holding parts 7, 7*a* are disposed on the hanger 1 at a distance from one another, thus facilitating the generation of a superior holding force.

Figure 7:
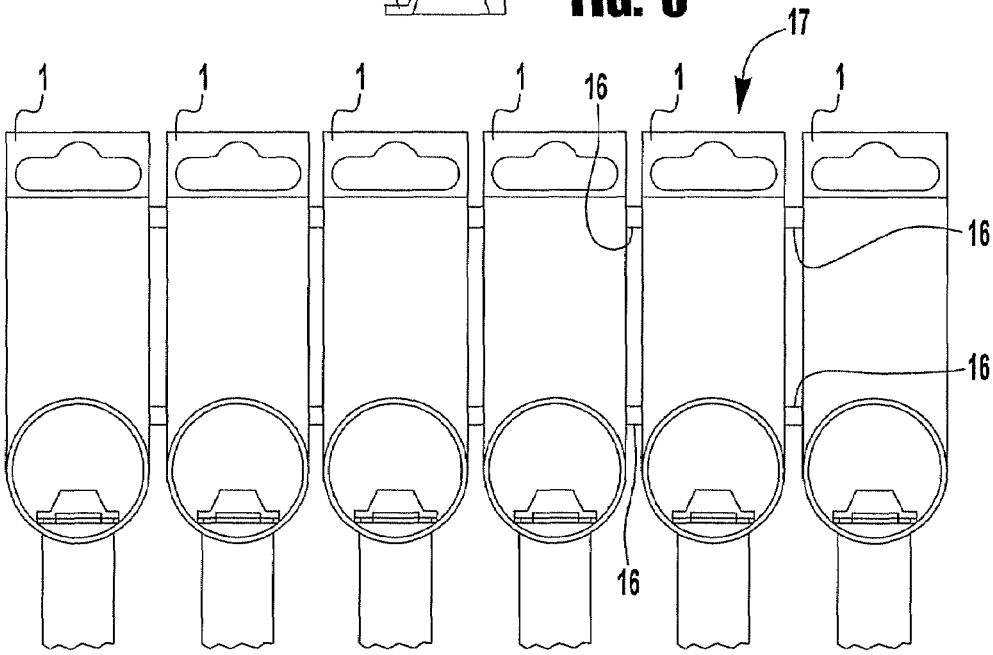
FIG. 7 is a front view of packaging for multiple objects

FIG. 7 shows a multiple holder 17 comprising a plurality of individual hangers 1 which are connected to one another by means of connective webs 16.

Depending on the product size and number of presentations, one or several connective webs 16 may be removed in order to form one, two, or three multiple holders or single holders out of the multiple holder 17.

It should also be noted that it is preferred to have the cone aperture 8 of the holding part 7 completely envelop the drill 20 to be held, i.e. over the entire circumference thereof. However, the invention is not limited to this feature. In another embodiment, the drill to be held may also be partially enveloped, while both cases result in the holding part settling elastomericly deformably against the circumference of the drill to be held.

Figure 10:
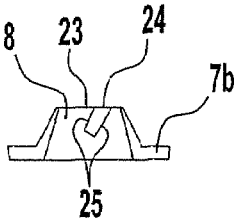
FIG. 10 is a sectional view of the top holding part in the second embodiment
Figure 9:
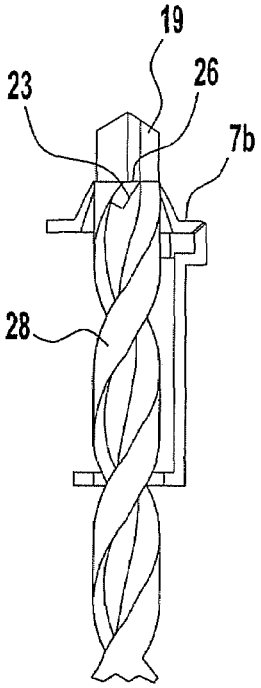
FIG. 9 is an enlarged partial view of FIG. 8
Figure 8:
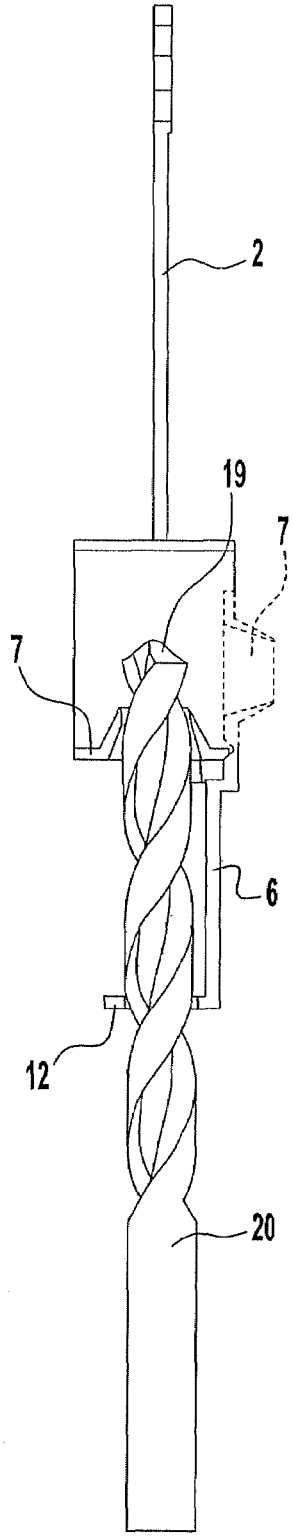
FIG. 8 is a sectional view of an additional embodiment of a hanger

FIGS. 8 through 10, in contrast to the embodiment according to FIGS. 1 through 7, show a different embodiment of a holding part 7*b*. A holding mechanism of this type is particularly suitable for holding stone drills. The drill point 19 has a greater diameter than the shank attached to the drill point of the drill 20, so that stop surfaces are formed on the lower edge 26 of the drill point 19, said stop surfaces functioning in cooperation with stop surfaces on the holding part 7*b*. For this purpose, in the area of the cone aperture 8 on the interior surface of the holding part 7*b*, one or several stop ribs 23 are disposed and evenly distributed over the circumference, the pitch of the said stop ribs 23 being approximately helix-shaped and corresponding approximately to the helix-shaped pitch of the drill shank. Thus, the stop ribs settle snugly into the helix-shaped pitch of the drill and generate an additional friction fit on the drill shank.

Naturally, the invention is not limited to one or several helix-shaped stop ribs 23. The stop ribs 23 may also be oriented at a slant (and thus not helix-shaped) or precisely vertically. In any case, they are integrated into the material of the holding part 7*b* as one unit and form one part with the same.

It is important that the upper front side of the stop ribs 23 form an additional stop surface 24 settling against the lower edge 26 of the drill point 19, thus additionally holding the same. With this additional feature (arrangement of one or several stop ribs 23), therefore, even very heavy stone drills can be held reliably.

Figure 11:
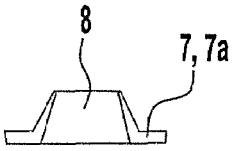
FIG. 11 is a sectional view of the top holding part in the first embodiment

FIG. 11 shows an upper holding part 7, 7*a*, as the one used for the embodiment according to FIGS. 1 through 7. The interior of the sleeve-shaped part does not contain any stop ribs 23.

Figure 12:
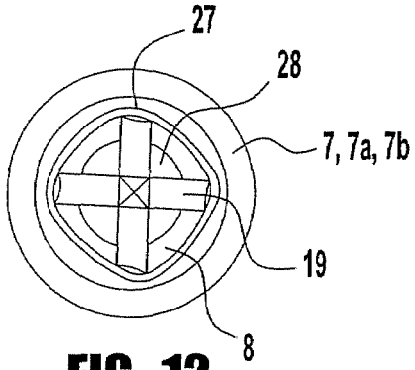
FIG. 12 is the top view of the top holding part as deformed by the drill.

FIG. 12 shows the elastomeric deformation of the upper holding part by the drill point 19 penetrating through the cone aperture 8, with the outer circumference of the drill helices 28 settling against the interior of the cone aperture 8 with the stop surfaces 27, and with the rim of the cone aperture being elastically deformed to settle against the drill helices 28 in a friction fit. Furthermore, the drill point 19 (with expanded diameter) is supported additionally from below by the stop surfaces 24 represented in FIG. 10.

LEGEND FOR THE DRAWINGS

1 Hanger
2 Tag face
3 Hole
4 Protective aperture
5 Ring wall
6 Sleeve-like part
7 (Upper) holding part 7*a*, 7*b*
8 Cone aperture
9 Film hinge
10 Stop
11 Ring surface
12 (Lower) holding part
13 Protective space
14 Holding web
15 Ring collar
16 Connective web
17 Multiple holder
18 Direction of arrow
19 Drill point
20 Drill
21 Ring surface
22 Receiving aperture
23 Stop rib
24 Stop surface
25 Guide surface
26 Lower edge
27 Contact surface
28 Drill helix

The invention claimed is:

1. A hanger and a drill that has a drill point and also that has drill helices, said hanger comprising:

a tag face having an upper area with a hole for receiving a hanger; and at least one holding part that is located on said tag face and that expands radially outwardly and is elastically deformable in response to said drill when it is inserted therein with the point of said drill penetrating said elastically deformable holding part, said elastically deformable holding part being an upper holding part that forms a ring surface that defines a cone in the center of the ring surface for receiving and holding said drill, wherein the lower area of the cone is larger than the diameter of said drill, said drill hanging from the holding part to force-close said cone such that the wall of said cone settles against the outer circumference of the drill to hold said drill by the elasticity and by the shape of said cone, said cone at least partially enveloping the drill and enclosing the outer circumference of said drill in a frictional fit to hold said drill by the drill point.

2. The hanger according to claim 1 wherein said elastically deformable holding part holds said drill with the drill point oriented upwardly, said elastically deformable holding part being disposed close to said tag face.

3. The hanger according to claim 1 wherein said elastically deformable holding part includes at least one stop rib that is disposed within the interior of said cone, said stop rib settling against the lower edge of said drill point of said drill in which the diameter of said drill point is larger than the diameter of said drill helices so that said drill defines a lower edge between said drill point and said drill helices.

4. The hanger according to claim 1, 2 or 3, said hanger further comprising an additional holding part that is disposed apart from said elastically deformable holding part, said additional holding part having holding webs that settle against the outer circumference of said drill to provide a centering function.

5. The hanger according to claim 3 wherein said drill is screwed or driven through said elastically deformable holding part with said drill point turned upward.

6. The hanger according to claim 3 wherein said tag face defines a protective aperture in the area of said elastically deformable holding part, said protective aperture at least partially enveloping the point of said drill held therein.

7. The hanger according to claim 6 wherein said protective aperture is formed in the plane of said tag face, said protective aperture forming an encircling ring wall that extends axially forward.

8. The hanger according to claim 7 wherein a film hinge pivotally connects said elastically deformable holding part to a holding surface in the lower area of said encircling ring wall.

9. The hanger according to claim 1, 2 or 3 wherein said tag face extends downwardly as an approximately semicircular sleeve to define a lower holding part at the lower, free end of said tag face.

10. The hanger according to claim 8 further including two spatially separate stops in the lower area of said protective aperture, said elastically deformable holding part that is pivotally connected to said holding surface resting and supported on said separate stops.

11. A hanger according to claim 9 wherein said lower holding part comprises an encircling ring surface with holding webs that extend radially inward from said ring surface to the interior said holding webs settling against the outer circumference of the drill.

12. A hanger according to claim 9 wherein said lower holding part defines a protective space that at least partially envelops and protects the outer circumference of the drill.

13. A hanger according to claim 1, 2 or 3 and further comprising a second elastically deformable holding part that is disposed on said tag face at a distance apart from said elastically deformable holding part.

14. A multiple hanger comprising a plurality of individual hangers according to claim 1, said plurality of individual hangers being connected by removable connective webs.

15. A hanger and a drill that has a drill point and also that has drill helices, said hanger comprising:

a tag face having in the upper area of the tag face a hole for receiving a hanger; and at least one holding device, said holding device located on said tag face and also being an elastically deformable holding part, said tag face defining a protective aperture in the area of said elastically deformable holding part, said protective aperture at least partially enveloping said point of said drill held therein, said holding device being elastically deformable in response to said drill that is inserted therein with said point of said drill penetrating said elastically deformable holding part, said elastically deformable holding part being an upper holding part that forms a ring surface that defines a cone in the center of said ring surface for receiving said drill, said cone at least partially enveloping said drill and enclosing the outer circumference of said drill in a frictional fit to hold said drill by said drill point.

16. A hanger and a drill that has a drill point and also that has drill helices, said hanger comprising:

a tag face having in the upper area of the tag face a hole for receiving a hanger;

at least one holding device, said holding device being located on said tag face and also being an elastically deformable holding part having at least one stop rib that is disposed within the interior of said elastically deformable holding part, said stop rib settling against the lower edge of said drill point of said drill in which the diameter of said drill point is larger than the diameter of said drill helices so that said drill defines a lower edge between said drill point and said drill helices, said holding device being elastically deformable in response to said drill that is inserted therein with the point of said drill penetrating said elastically deformable holding part, said elastically deformable holding part being an upper holding part that forms a ring surface that defines a cone in the center of the said ring surface for receiving said drill, said cone at least partially enveloping said drill and enclosing the outer circumference of said drill in a frictional fit to hold said drill by said drilling point, said tag face defining a protective aperture that extends axially forward and that forms an encircling ring wall in the tag face in the area of said elastically deformable holding part, said protective aperture at least partially enveloping the point of the drill held therein; and a filming hinge that pivotally connects said elastically deformable holding part to a holding surface in the lower area of said ring wall.

17. The hanger according to claim 16 further including two spatially separate stops in the lower area of said protective aperture , said elastically deformable holding part that is pivotally connected to said holding surface resting and supported on said separate stops.

* * * * *